US007159248B1

(12) United States Patent
Saintlot

(10) Patent No.: US 7,159,248 B1
(45) Date of Patent: Jan. 9, 2007

(54) HEAD COVERING WITH ATTACHED WHISTLE

(76) Inventor: Jean Robert Saintlot, 676 Riverside Dr. #7B, New York, NY (US) 10031

( * ) Notice: Subject to any disclaimer, the term of this patent is extended or adjusted under 35 U.S.C. 154(b) by 173 days.

(21) Appl. No.: 10/888,773

(22) Filed: Jul. 9, 2004

(51) Int. Cl.
*A42B 1/18* (2006.01)

(52) U.S. Cl. ..... 2/206; 2/207; 2/209.13

(58) Field of Classification Search ..... 2/10, 2/171.5, 183, 195.3, 195.7, 181.2, 209.13, 2/209.11, 207, 206; 446/27, 204; 116/24
See application file for complete search history.

(56) References Cited

U.S. PATENT DOCUMENTS 3,824,949 A * 7/1974 Aquila ..... 116/137 R
5,072,598 A 12/1991 Dibrell ..... 62/259
5,504,943 A 4/1996 Han ..... 2/209.13
6,032,292 A 3/2000 Wood ..... 2/207
6,112,330 A * 9/2000 Bryan ..... 2/160
6,209,140 B1 * 4/2001 Ebeling ..... 2/207
6,237,162 B1 * 5/2001 Gill ..... 2/422
6,523,182 B1 * 2/2003 Brawner ..... 2/207

* cited by examiner

*Primary Examiner*—Katherine Moran
*Assistant Examiner*—Richale L. Haney
(74) *Attorney, Agent, or Firm*—Goldstein Law Offices

(57) ABSTRACT

A head covering with an attached whistle. The generally square head covering has a top edge, a bottom edge, a left side edge, a right side edge, a front surface and a rear surface. A relatively narrow channel is present inside the covering near the top edge. The channel begins at a left opening in the left side edge and ends at a right opening in the right side edge. A long cloth cord extends for a first distance outside the head covering, through the channel and for a second distance outside the head covering. The cord has a first end that is free, a second end that is attached to a whistle, a left knot near the left opening and a right knot near the right opening. The left knot and right knot prevent the cord from slipping out of the channel while a user is in motion.

3 Claims, 1 Drawing Sheet

HEAD COVERING WITH ATTACHED WHISTLE

BACKGROUND OF THE INVENTION

1. Field of the Invention

The invention generally relates to a bandana, and in particular it relates to a head covering with an attached whistle.

2. Description of the Related Art

As most people are well aware, typical bandanas are square pieces of cotton that are generally made from a cotton fabric with a spotted or floral pattern design. Since bandanas have symbolized all-American values such as hard work and rugged independence in the public consciousness over the past century, they are generally thought of as distinctively American. Underlying this view is a perceived closeness to an imagined past filled with forebears who tilled the soil, sailed the seas and tamed the frontier. Thus, few Americans today are aware that the word "bandana" and the original textile used for its manufacture were both imported from India. Although bandanas were a distinctly exotic import in the eighteenth century, they gradually became widely used and were considered quintessentially American in the nineteenth century. The word "bandana" derives either from Hindustani, the language spoken by traders before India's independence, or from Bengali, the language of the region in which bandanas were made. In both languages, the word means "tie-dyed", the technique by which small sections of cloth are tightly wrapped with thread to prevent dye from penetrating therethrough.

Offered today in colorful solids and paisley prints, versatile and easily donned bandanas appeal to virtually all walks of life. In recent years, bandanas have become benchmarks of casual fashion and consequently are widely worn by teenagers, laborers and celebrities, among others. Bandanas often serve multiple purposes, including coordinating a casual wardrobe, protecting the head from the elements and disguising a bad hair day. However, currently available bandanas do not generally serve the purpose of drawing the attention of others to the person who is wearing it upon a moment's notice. Such functionality would be useful under numerous circumstances, such as when playing a sport, attending a political or other social rally and fearing for one's physical safety when unwittingly placed in an unsafe situation. Hence, there is a pressing and broadly felt need for a bandana that includes means of loudly and quickly alerting others of the presence of the user.

U.S. Pat. No. 5,072,598 to Dibrell ("Dibrell") teaches a scarf that can be wrapped around the neck or other body area of a user and perform a heat-transfer operation thereon. However, the scarf of Dibrell provides absolutely no means of drawing attention to its user.

U.S. Pat. No. 5,504,943 to Han ("Han") discloses headgear that has an attachable whistle. However, an electric disc is attached to the headgear of Han via an electrical wire. Hence, a user could not safely wear the headgear of Han when it is raining or snowing.

U.S. Pat. No. 6,032,292 to Wood et al. ("Wood") teaches an adjustable multi-layer square of material that can be formed into a bandana or scarf and that has means for supporting glasses or goggles. However, the bandana of Wood provides absolutely no means of drawing attention to its user.

While these devices may be suitable for the particular purposes employed, or for general use, they would not be as suitable for the purposes of the present invention as disclosed hereafter.

SUMMARY OF THE INVENTION

It is an object of the invention to provide a bandana that a user can easily put on and take off his head. Accordingly, a head covering of the bandana has a square configuration. A user can readily wrap the corners of the head covering behind his head and tie them together in a secure knot.

It is another object of the invention to provide a bandana that visually appeals to the stylistic tastes of a wide variety of consumers. Accordingly, the front and rear surfaces of the head covering can contain numerous combinations of colors, designs and patterns.

It is a further object of the invention to provide a bandana that effectively keeps the hair and forehead of the user dry when he engages in physical activity. Accordingly, the head covering is relatively thick and is constructed from a highly absorbent cotton or poly-cotton blend.

It is a further object of the invention to provide a bandana that the user can employ to quickly draw the attention of others to him. Accordingly, a whistle is attached to the head covering. The user can readily grasp and utilize the whistle to generate a shrill sound.

It is a further object of the invention to provide a bandana that the user can utilize to notify people who are a long distance away from him of his presence. Accordingly, the attached whistle has an exceptionally high pitch regardless of the intensity with which the user blows into it.

The invention is a head covering with an attached whistle. The generally square head covering has a top edge, a bottom edge, a left side edge, a right side edge, a front surface and a rear surface. A relatively narrow channel is present inside the covering near the top edge. The channel begins at a left opening in the left side edge and ends at a right opening in the right side edge. A long cloth cord extends for a first distance outside the head covering, through the channel and for a second distance outside the head covering. The cord has a first end that is free, a second end that is attached to a whistle, a left knot near the left opening and a right knot near the right opening. The left knot and right knot prevent the cord from slipping out of the channel while a user is in motion.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
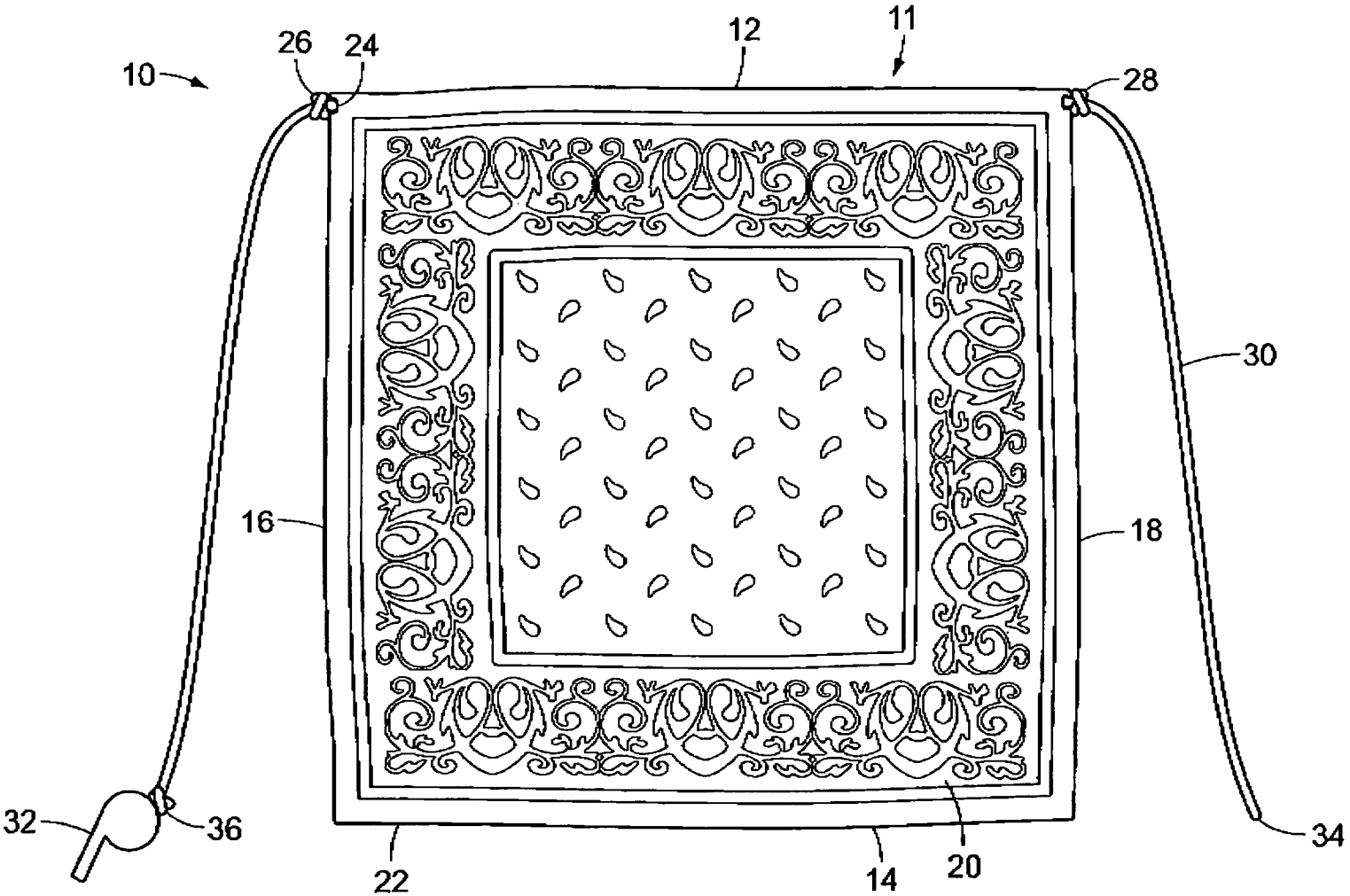
FIG. 1 is a front elevational view of a bandana according to the present invention.

FIG. 1 is a front elevational view of a bandana 10 according to the present invention. The bandana 10 has a generally square head covering 11 with a top edge 12, a bottom edge 14, a left side edge 16, a right side edge 18, a front surface 20 and a rear surface 22. A relatively narrow channel 24 is present inside the bandana 10 near the top edge 12. The channel 24 begins at a left opening in the left side edge 16 and ends at a right opening in the right side edge 18. A long and continuous woven-cloth cord 30 extends for a first distance outside the head covering 11, through the channel 24 and for a second distance outside the head covering 11. Preferably, the first distance approximately equals the second distance. The cord 30 has a first end 34 that is free and a second end 36 that is attached to a whistle 32. Any suitable fastening means can be used to secure the whistle 32 to the second end 36, including a knot or a metal clasp. A left knot 26 is present in the cord 30 near the left opening, and a right knot 28 exists in the cord 30 near the right opening. The left knot 26 and the right knot 28 prevent the cord 30 from slipping out of the channel 24 while a user is in motion.

The front surface 20 and the rear surface 22 of the head covering 11 can contain numerous combinations of colors, designs and patterns such as various striking solids, shimmering pastels, intricate paisleys, sports team logos, flag renderings and whimsical cartoon illustrations. In addition, the head covering 11 is relatively thick and is constructed from a highly absorbent cotton or poly-cotton blend. Thus, the head covering 11 effectively keeps the hair and forehead of the user dry when he engages in strenuous physical activity or when it is lightly raining or snowing outside. Furthermore, the whistle 32 has an exceptionally high pitch that enables the user to draw the attention of people who are a long distance away from him. This phenomenon occurs even if the user blows into the whistle 32 with only minimal intensity.

In order to utilize the bandana 10, the user holds the rear surface 22 of the head covering 11 against his forehead such that the bottom edge 14 is positioned above his eyes but below his hairline and the top edge 12 rests against the back of his neck. The user then centers the head covering 11 on his forehead, wraps the corners together behind his head and ties the corners together in a secure knot. The user can readily grasp the whistle 32 and employ it to generate a shrill sound for any purpose whatsoever.

In conclusion, herein is presented a head covering with an attached whistle. The invention is illustrated by example in the drawing figures, and throughout the written description. It should be understood that numerous variations are possible, while adhering to the inventive concept. Such variations are contemplated as being a part of the present invention.

What is claimed is:

1. A bandana for keeping hair of a user dry and drawing attention of others to the user, the bandana comprising a head covering, a cord and a whistle, the head covering having a top edge, a bottom edge, a left side edge, a right side edge, a front surface and a rear surface, the cord extending inside the head covering, the cord having a first end that is free and a second end that is attached to the whistle, wherein the head covering has a substantially square configuration.

2. The bandana as recited in claim 1, further comprising a channel, the channel beginning at a left opening in the left side edge and ending at a right opening in the right side edge, wherein the cord extends for a first distance outside the head covering, through the channel and for a second distance outside the head covering.

3. The bandana as recited in claim 2, wherein the cord has a left knot near the left opening and a right knot near the right opening, the left knot and the right knot preventing the cord from slipping while the user is in motion.

* * * * *